United States Patent [19]

Gerber

[11] Patent Number: 4,779,725

[45] Date of Patent: Oct. 25, 1988

[54] STACKABLE GOLF BAG

[75] Inventor: Curtis E. Gerber, Tampa, Fla.

[73] Assignee: Tampa G Manufacturing Co., Tampa, Fla.

[21] Appl. No.: 20,961

[22] Filed: Mar. 3, 1987

[51] Int. Cl.[4] ..... A63B 55/00

[52] U.S. Cl. ..... 206/315.3; 206/315.4; 206/315.5; 206/315.6; 206/315.9; 206/503

[58] Field of Search ..... 206/315.3, 315.4, 315.6, 206/315.7, 315.9

[56] References Cited

U.S. PATENT DOCUMENTS

| | | | |
|---|---|---|---|
| D. 172,785 | 8/1954 | Eging . | |
| D. 278,479 | 4/1985 | Bevilacqua et al. . | |
| 1,600,601 | 9/1926 | Sampson . | |
| 2,685,317 | 8/1954 | Lace et al. . | |
| 2,760,782 | 8/1956 | Hartzell . | |
| 3,460,597 | 8/1969 | Daly . | |
| 3,530,919 | 9/1970 | May . | |
| 3,848,737 | 11/1974 | Kenon . | |
| 4,142,563 | 3/1979 | Ackerfeldt et al. | 206/315.5 |
| 4,245,684 | 1/1981 | Street et al. . | |
| 4,350,194 | 9/1982 | Brown | 206/315.5 |
| 4,383,563 | 5/1983 | Kirchoff, Jr. . | |
| 4,522,299 | 6/1985 | Clark et al. . | |

FOREIGN PATENT DOCUMENTS

| | | | |
|---|---|---|---|
| 1292249 | 3/1962 | France | 206/315.3 |
| 333282 | 8/1930 | United Kingdom | 206/315.3 |
| 345825 | 4/1931 | United Kingdom | 206/315.3 |
| 358195 | 10/1931 | United Kingdom | 206/315.3 |

*Primary Examiner*—William Price

*Attorney, Agent, or Firm*—Dominik, Stein, Saccocio, Reese, Colitz & Van Der Wall

[57] ABSTRACT

A golf bag is disclosed comprising a T-shaped configuration for containing a regulation set of golf clubs and related golf accessories. A plurality of golf club compartments are positioned at the upper end of the golf bag for receiving the heads of golf clubs and causing such golf clubs to be suspended by their heads within respective golf club tubes. A cover is removably mounted about the upper portion of the golf bag to retain and protect the golf clubs during transport. A golf ball dispenser is provided for storage of golf balls.

14 Claims, 3 Drawing Sheets

Fig. 3
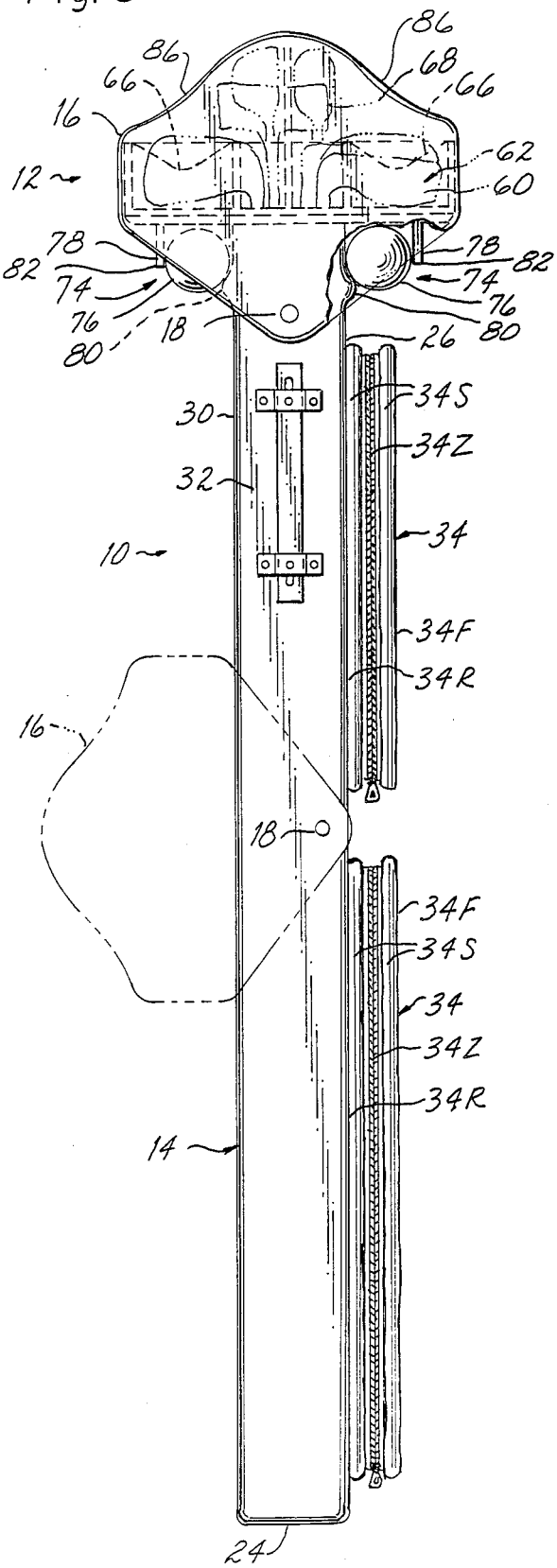
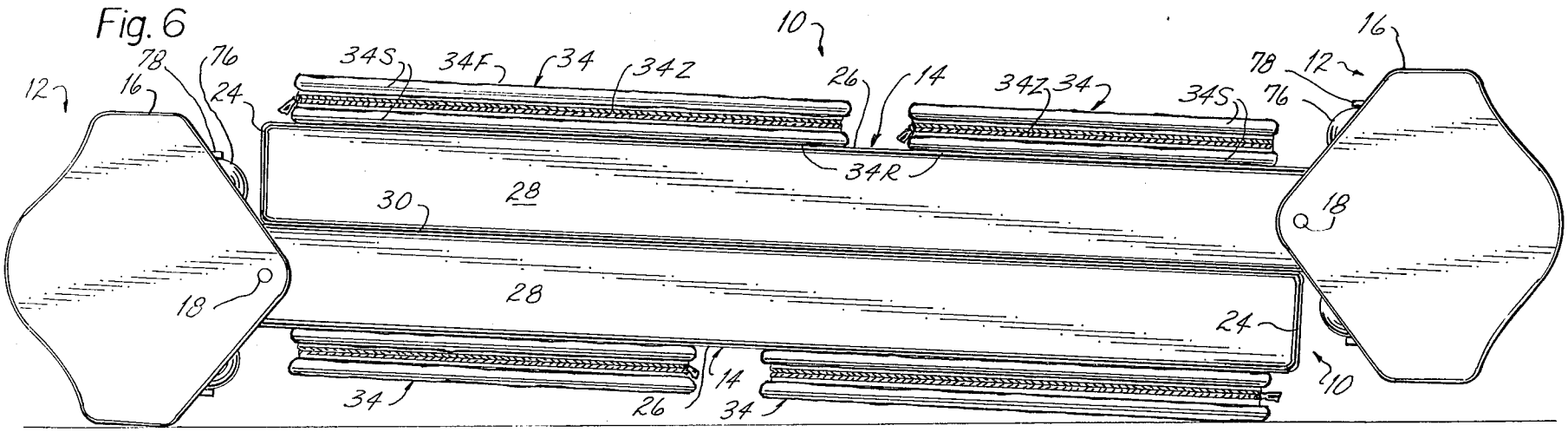
Fig. 6

STACKABLE GOLF BAG

BACKGROUND OF THE INVENTION

1. Field of the Invention

This invention relates to golf bags designed to carry a regulation set of golf clubs and related accessories. More particularly, this invention relates to golf bags composed of a rigid material having a plurality of longitudinal tubes formed along the length thereof for receiving the golf clubs.

2. Description of the Background Art

Presently, there exist many types of golf bags designed to store and carry a set of golf clubs and related accessories. Undoubtedly, the most predominant type of golf bag comprises a generally cylindrical design having a closed bottom and an open top allowing golf clubs to be inserted, handle first, therein. A shoulder strap is adjustably fixed along one longitudinal side of the golf bag, allowing it to be shoulder carried. Usually, several pockets are provided about the periphery of the golf bag for storage of golf balls, tees and related golf accessories. Other larger pockets are sometimes provided for storage of clothing, such as a change of clothes.

Without a doubt, the cylindrically shaped golf bag described above is the most widely used by golfers. However, some disadvantages are associated with such cylindrical golf bags which reduce the portability of the golf bags during transit, the storage capacity and the segregation of the golf clubs during storage within the bag for subsequent use. Specifically, even when large pockets are provided about the periphery of the golf bag, the cylindrical design of the golf bag, and the pocket formed partially therearound, significantly reduces the capability of storing an additional change of clothing therein without excessive wrinkling. As a result, many golfers make use of a separate suitcase to carry a clothing change after their game in lieu of storage of such clothing in the golf bags themselves.

Cylindrical golf bags are not readily transportable because of their excessive bulkiness and the resulting inability or difficulty in placing several golf bags in modern day, usually compact, automotive trunk storage. Of course, this disadvantage is compounded when the golfers carry an additional change of clothes in separate pieces of luggage which must also be stored in the trunk of an automobile. As a result, many times, the golf clubs and other luggage must be placed on the rear seat of the automobile for transport because of such bulkiness. However, it is readily apparent that a group of four golfers in a single automobile along with their associated golf bags and luggage, creates an extremely uncomfortable, tight quartered condition within the automobile during the trip to the golf course and during their return therefrom. Still another disadvantage associated with cylindrical type golf bags is the usual lack of durability to withstand rough handling in the event of transport by commercial services such as airlines, buses, or rail lines. Damage to the golf clubs contained therein may even result due to such rough handling.

Several attempts have been made to overcome the aforementioned disadvantages associated with cylindrical type golf bags. U.S. Pat. Nos. 3,460,597 and 4,522,299 disclose recent variations in golf bags as including a generally oval shaped cross-sectional configuration providing a somewhat flatter surface for pockets and the somewhat more compact design facilitating storage and transport. Rectangular shaped golf bags are disclosed in U.S. Pat. Nos. 4,383,563, 2,760,782, 1,600,601, 2,685,317, and 3,530,919. These rectangular shaped golf bags offer many features not found with cylindrical type golf bags such as improved pocket areas, improved holders for golf accessories, such as golf balls, and improved types of retractable wheels and handles for the golf cart. Notwithstanding, even these oval and rectangular shaped golf bags are bulky to handle and not easily stacked, one with another, for compact storage in a small area such as the trunk of an automobile.

Therefore, it is an object of this invention to provide an apparatus which overcomes the aforementioned inadequacies of the prior art devices and provides an improvement which is a significant contribution to the advancement of the golf bag art.

Another object of this invention is to provide a compact golf bag particularly designed to be nested with other, similarly designed golf bags for compact storage during transport in the trunk of an automobile.

Another object of this invention is to provide a golf bag for containing a regulation set of golf clubs and related accessories, such as golf balls, in such a manner that the golfer may quickly and easily remove a selected golf club or golf ball from the bag.

Another object of this invention is to provide a golf bag manufactured from a rigid material capable of withstanding the rigors of commercial transport without damage.

Another object of this invention is to provide a golf bag which is economical to manufacture with existing manufacturing techniques.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a stackable golf bag composed of a rigid material, for holding a regulation set of golf clubs, related golf accessories and other items, such as clothing, in a unique, space-efficient manner such that a plurality of such golf bags may be compactly nested together in a stacked arrangement for storage in small compartments such as a trunk of an automobile.

More specifically, the golf bag of the invention comprises a generally T-shaped configuration having a regulation set of golf club tubes longitudinally formed within the length of the golf bag. The tubes are uniquely positioned to form a double row of seven golf club tubes (corresponding to a regulation set of fourteen clubs) with the tubes of one row being positioned immediately adjacent to the corresponding tubes of the adjacent row. Positioned at the upper end of the golf bag are a plurality of golf club compartments for receiving the heads of the golf clubs and causing such golf clubs to be suspended by their heads within the respective golf club tubes. Suspension of the golf clubs by their heads minimizes movement of the golf clubs within the golf bag, particularly reducing the striking of one club head against another, thereby minimizing damage to or marring of the golf clubs during transport. A rigid cover is removably mounted to opposing upper sides of the golf bag and is formed about the upper portion of the golf bag to retain and protect the golf clubs therein during transport. Finally, a golf ball dispenser is provided underneath both sides of the head portion of the golf bag for storage of golf balls.

The aforementioned golf bag of the invention includes many features which would be highly desired by golfers. Notably, a plurality of rectangularly shaped pockets may be permanently or removably fastened to opposing flat sides of the longitudinal portions of the golf bag, thereby allowing a full change of clothing and other items to be conveniently stored therein. The T configuration of the golf bag allows one bag to be nested upon another bag, each in reverse order to the other, to form a highly compact arrangement for storing two complete golf bags, each filled with golf equipment. Indeed, it is estimated that the thickness of the longitudinal portion of the golf bag will be approximately four inches and the thickness of the pockets positioned along one side thereof would be approximately two inches. Hence, when two such bags are stacked together in such nested form, it is readily apparent that the total overall thickness is a mere twelve inches. Obviously, a great space savings is obtained over conventional twelve inch cylindrical type golf bags.

Other advantages of the golf bag of the invention include the ability to invert the golf bag so that it may be hung, inverted, in a closet or in the storage compartment of an airplane. Moreover, due to the head portion being suspended below the normal length of clothing sharing the closet space, it is readily apparent that the golf bag, when hung, will occupy no more than four inches of hanger space. Additionally, the removability of the pockets allow the same to be removed and quickly and easily packed with clothing in a neat manner without wrinkling and then be reinstalled.

The golf bag itself includes the features of individually protecting each golf club in its own head and shaft compartment. This feature, coupled with the suspension of the golf clubs by the heads within the bag, assures that no damage or other marring will occur to the golf clubs during storage or transport. When in play, it is noted that each golf club is organized with their numbers pointed upwardly, allowing the golfer to immediately select the desired club and, after play, to conveniently reinsert such club into the golf bag. Finally, it is noted that the golf ball dispensers are conveniently positioned underneath the head of the golf club compartment of the golf bag allowing quick removal of a single golf ball.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 3 is an edge view of FIG. 1, partially cut away, illustrating the ball dispensing means positioned underneath the front and rear sides of the head portion of the golf bag;

FIG. 6 is an edge view of a pair of golf bags of the invention nested together in a stacked configuration for compact storage during transport.

Similar reference characters refer to similar parts throughout the several views of the drawings.

DETAILED DESCRIPTION OF THE PREFERRED EMBODIMENT

Figure 1:
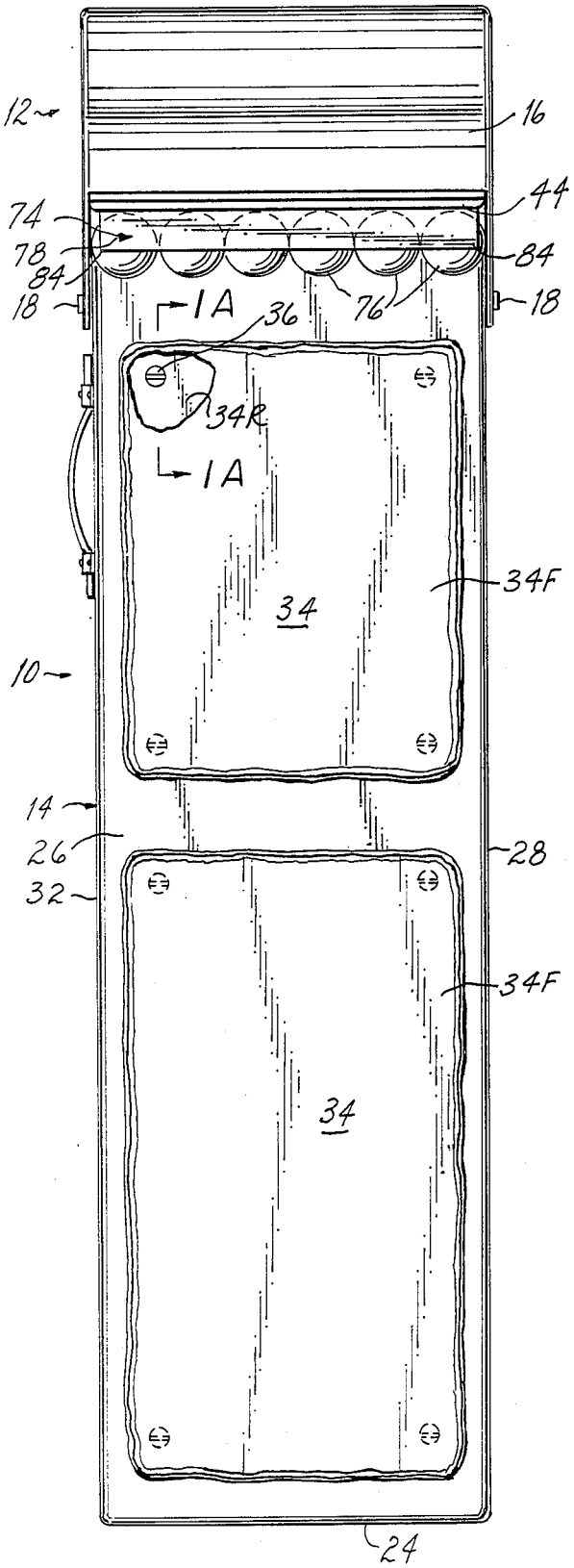
FIG. 1 is a front view of a golf bag of the invention, illustrating the cover thereof in a closed position and illustrating the pockets thereof removably positioned along the length of the golf bag.
Figure 2:
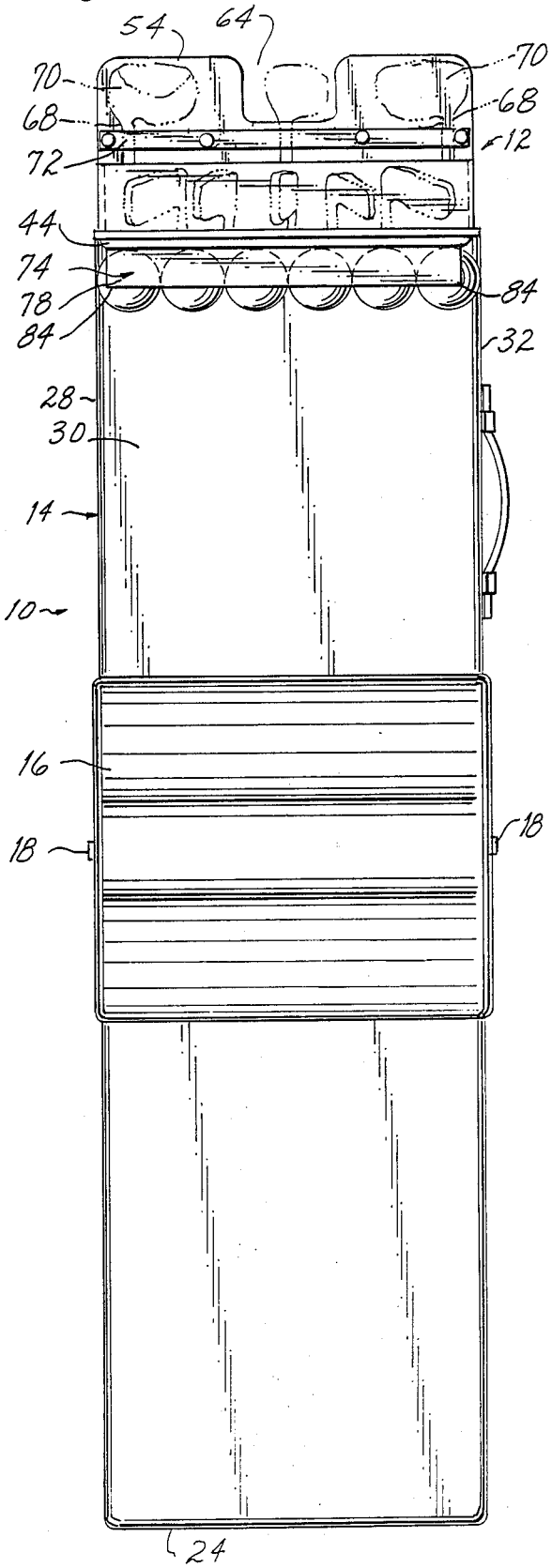
FIG. 2 is a rear view of a golf bag of the invention with the cover thereof in an opened position to illustrate the interior configuration of the head portion of the golf bag.

Referring to FIGS. 1–3, the golf bag 10 of the invention comprises a head portion, generally indicated by numeral 12, and a longitudinal body portion 14 extending therefrom to define a generally T-shaped configuration when viewed from the side of the golf bag 10 (see FIG. 3). A cover 16, is removably mounted to opposing sides of the golf bag 10 at pressure points 18 allowing the cover 16 to be removed to allow access to the interior of the head portion 12. When opened, cover member 16 may be mounted to the side of the golf bag 10 (see FIG. 2).

Figure 4:
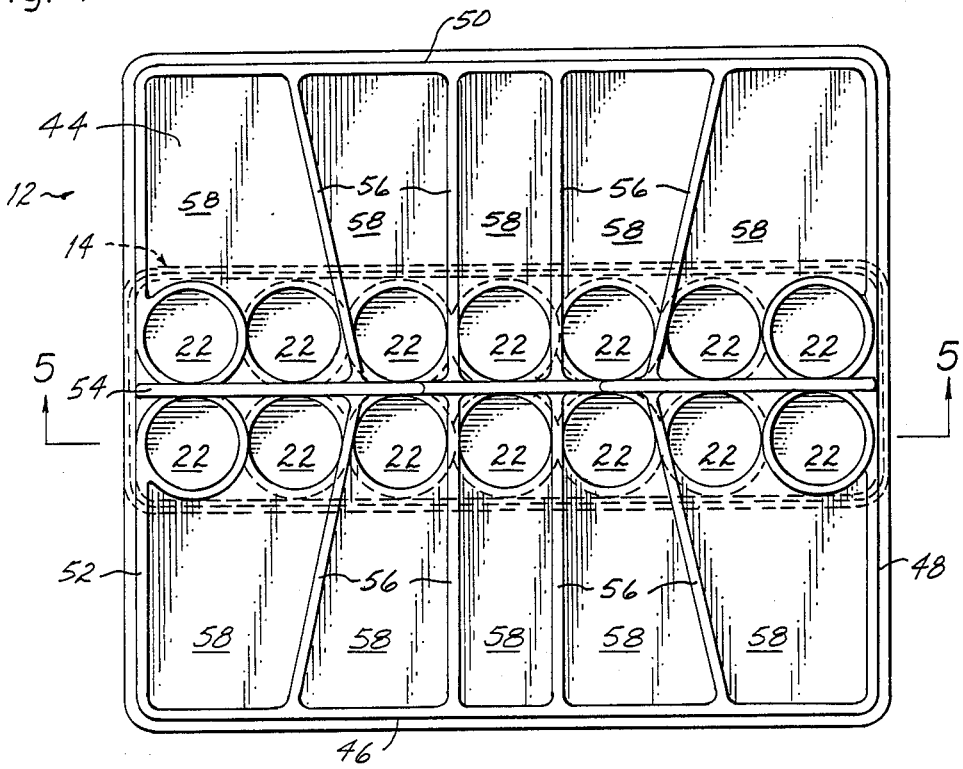
FIG. 4 is a top view of FIG. 1, illustrating the interior configuration of the head portion of the golf bag.
Figure 5:
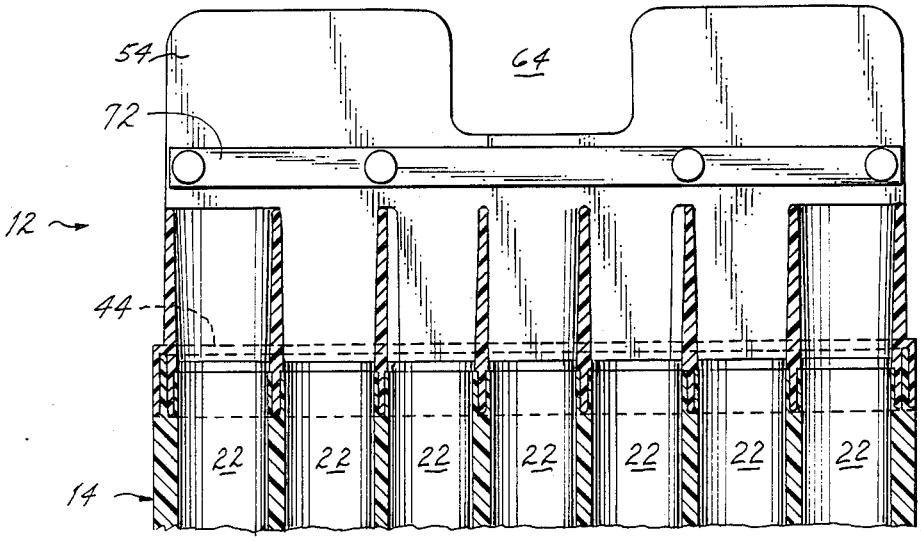
FIG. 5 is a partial cross-sectional view of FIG. 4, along lines 5—5, illustrating the cross-sectional configuration of one row of golf club tubes positioned along the length of the golf bags.

Referring specifically to FIGS. 4 and 5, the longitudinal body portion 14 includes plurality of golf club tubes 22 positioned along the length thereof from the head portion 12 to the bottom 24 of the body portion 14 and are completely enclosed by respective front, rear, left and right side members 26–32 defining a rectangular configuration with bottom 24. Preferably, a total of fourteen tubes 22 are positioned within the body portion 14 in a double row arrangement with each row including seven tubes 22 and with each tube 22 of each row being positioned immediately adjacent to its adjacent tubes in the same row and its companion tubes 22 in the row. In this manner, a compact arrangement is attained for storage of a regulation set of golf clubs in a thin, rectangular configuration approximating four inches by eight inches in cross-section.

Referring to FIG. 6, the thin rectangular configuration of the longitudinal body portion 14 enables a pair of golf bags 10 of the invention to be compactly nested together, one on top of the other, in reverse direction, for compact storage in an area such as the trunk of an automobile. Indeed, it is noted that such a stacked pair of golf bags 10 of the invention occupies substantially the same amount of room as a conventional twelve inch cylindrical-type golf bag.

Figure 1A:
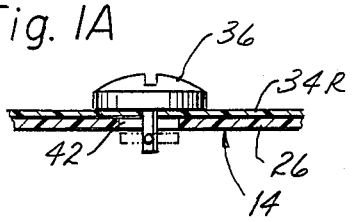
FIG. 1A is a partial cross-sectional view, illustrating one embodiment of a fastener for removably fastening the pockets to the golf bag, allowing the pockets to be removed and utilized as an accessory pouch or bag for storage of clothing or other items.

Referring again to FIGS. 1 and 3, a pair of pockets 34 are provided along the front side 26 of the longitudinal body portion 14 for storage of clothes, golf accessories, or other items. Pockets 34 are preferably rectangular in shape, corresponding to the width of the front side 26, such that two pockets 34 cover the majority of the front side 26 of the body portion 14. Also preferably, pockets 34 include front and rear members 34F and 34R, joined together by side panels 34S and zipper 34Z. Still more preferably, zipper 34Z. extends about three edges of the pockets 34 allowing the pocket 34 to be fully opened in a notebook fashion. It is noted that the side panels 34S are collapsible in an accordion-shaped manner, allowing the pockets 34 to be compactly folded against the front side 26 of the body portion 14 when empty. As shown in FIG. 1A, still more preferably, pockets 34 are removable from the front side 26 of the body portion 14 by means of a removable fastener 36, including a shaft portion and a cross T-portion which engages through a corresponding slot 42 formed in the front side 26 of the body portion 14 such that a quarter-turn rotation of each said fastener 36 removably secures the pockets 34 to the golf bag 10. Although not shown, similar pockets 34 may be removably affixed to the rear side 28 of the body portion 14 in a similar manner.

As shown in FIGS. 4 and 5, the head portion 12 of a golf bag 10 comprises bottom wall 44 through which tubes 22 extend and front, rear and left and right upstanding members 46–52 which define an open-ended configuration. An upstanding center member 54 extends from the bottom wall 44 dividing the two rows of tubes 22. Four divider walls 56 extend outwardly between the innermost five tubes 22 of each row to define five club head compartments 58 for the heads 60 of the iron golf clubs 62, as shown in phantom.

Referring to FIG. 5, each of the innermost ten tubes 22 defined to receive the ten irons 62 are configured to be substantially flush with the bottom wall 44 of the head portion 12 such that the irons 62, when positioned therein, are suspended by their heads 60 while being retained within their respective compartments 58. This suspension feature plus the isolation of one iron 62 from another within their respective compartments 58, assures that the irons 62 will not be damaged or marred. It is noted that the upstanding center member 54 may include a cut-out 64 allowing a mallet putter to be positioned in one of the two centermost tubes 22. It is also noted that each of the divider walls 56 may include a midsection recess 66 allowing the head 60 of the irons 62 to be easily grasped by the golfer and extracted from the golf bag 10.

The outermost tube 22 of each end of each row of tubes 22 are provided for receiving four wood clubs 68. However, it is noted that such four tubes 22 extend significantly beyond the bottom wall 44 of the head portion 12 such that the woods 68 are suspended by their heads 70 from the rim of the respective tubes 22. Elastic straps 72 may be affixed to the front and rear sides of the upstanding center member 54 for positioning about the heads 70 of the woods 68 and the head of the mallet putter (if one exists) to releasably secure the same to the center member 54, thereby preventing movement within the head portion 12.

A ball dispenser, generally indicated by numeral 74, is provided underneath the front and rear areas of the head portion 12 for storage of golf balls 76. Each ball dispenser 74 comprises a downwardly depending retainer flange 78 extending from the bottom wall 44 of the head portion 12 and a laterally extending protuberance 80, extending from the front and rear sides 26 and 28 of the body portion 14. The lateral protuberance 80 is positioned slightly below, but in alignment with, the lower edge 82 of the retainer flange 78 such that the balls 68 are pinned therebetween. It is noted that both corners 84 of the retainer flange 78 may be slightly formed inwardly to more securely retain the balls 76 between the flange 78 and the protuberance 80 to prevent the balls 76 from rolling out of the end of the channel formed by the flange 78 and the protuberance 80. Finally, as shown in FIG. 3, the ball dispensers 74 are more fully enclosed and therefore protected when the cover member 16 in its closed position. Additionally, it is noted that the cover member 16 includes an inwardly depressed portion 86 corresponding to the height of the irons 62 within the head portion 12 to more securely retain the irons 62 within the head portion 12 without shifting vertically therein.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention.

Now that the invention has been described, what is claimed is:

1. A golf bag for storing a regulation set of golf clubs including iron clubs and wood clubs and a plurality of golf balls, comprising in combination:

a head portion and a longitudinal body portion defining a generally T configuration;

said longitudinal portion including a plurality of golf club tubes positioned longitudinally therein in two rows with said golf club tubes being positioned adjacent to one another;

said head portion including front, rear and left and right side walls extending upwardly from a bottom wall to define an opened-ended structure with said golf club tubes extending through said bottom wall and an upstanding center member extending between said rows of said golf club tubes;

a plurality of divider walls extending from innermost said golf club tubes to define compartments for the heads of the iron clubs such that the iron clubs are suspended by their heads into said golf club tubes; and one of the outermost golf club tubes extending significantly beyond said bottom wall of said head portion for receiving a wood golf club therein allowing the wood golf club to be suspended by its head therefrom.

2. The golf bag as set forth in claim 1, further including a pocket affixed to a front side of said body portion for storage.

3. The golf bag as set forth in claim 2, further comprising a removable cover for positioning over said head portion of the golf bag, said cover including means for retaining the golf clubs in said golf club tubes in the golf bag.

4. The golf bag as set forth in claim 3, further including ball dispensing means positioned under said head portion for receiving and dispensing a plurality of golf balls therefrom.

5. The golf bag as set forth in claim 4, wherein said pocket is removably fastened to said body portion of the golf bag allowing said pocket to be removed therefrom and utilized as a separate bag.

6. The golf bag as set forth in claim 4, wherein said pocket comprises a rectangular, collapsible design capable of being folded flat when empty and capable of being fully opened along three edges by means of a continuous fastener such as a zipper.

7. The golf bag as set forth in claim 4, wherein each of the four outermost golf club tubes extend significantly beyond said bottom wall of said head portion for receiving four of the wood golf clubs therein while allowing the wood golf clubs to be suspended by their heads therefrom.

8. The golf bag as set forth in claim 7, further including strap means affixed to said upstanding center member for fastening over the heads of the wood golf clubs.

9. The golf bag as set forth in claim 4, further including a recess formed along the upper edge of said divider walls to facilitate grasping of the heads of the golf clubs positioned within said compartments.

10. The golf bag as set forth in claim 4, further including means for removably fastening said cover to the side of the golf bag.

11. The golf bag as set forth in claim 10, wherein said means for retaining the golf clubs in said golf club tubes comprises means for preventing significant vertical movement therein when said cover member is closed about said head portion.

12. The golf bag as set forth in claim 4, wherein said ball dispensing means comprises a depending retainer flange extending from said bottom wall of said head portion and a lateral protuberance extending from a front side of said body portion in alignment with said flange, whereby a golf ball may be removably secured therebetween.

13. The golf bag as set forth in claim 12, wherein an outside corner of said flange is formed inwardly to more securely retain a golf ball between said flange and said protuberance.

14. The golf bag as set forth in claim 12, wherein said cover further includes means for covering the ends of a channel formed by said flange and said protuberance.

* * * * *